United States Patent [19]

Blewitt et al.

[11] Patent Number: 4,544,908

[45] Date of Patent: Oct. 1, 1985

[54] FUSE WITH ELECTRO-NEGATIVE GAS INTERRUPTING MEANS

[75] Inventors: Donald D. Blewitt, Penn Hills; Tapan K. Gupta, Monroeville, both of Pa.

[73] Assignee: Westinghouse Electric Corp., Pittsburgh, Pa.

[21] Appl. No.: 569,071

[22] Filed: Jan. 9, 1984

[51] Int. Cl.[4] ..... H01H 85/44

[52] U.S. Cl. ..... 337/279; 337/158; 200/144 C

[58] Field of Search ..... 337/279, 273, 274, 275, 337/276, 278, 280, 158-162; 200/144 C, 148 G

[56] References Cited

U.S. PATENT DOCUMENTS 3,818,165 6/1974 Zavitsanos et al. ..... 200/144 C
4,183,004 1/1980 Kozacka ..... 337/158

FOREIGN PATENT DOCUMENTS 782038 4/1968 Canada ..... 200/144 C

*Primary Examiner*—Harold Broome
*Attorney, Agent, or Firm*—L. P. Johns

[57] ABSTRACT

There is provided by this invention a current limiting fuse having a fuse element wound about support means consisting of a non-stoichiometric oxide core that produces an electro-negative gas when heated by the melting fuse element. The generation of the electro-negative gas results in more rapid and efficient arc extinction.

4 Claims, 1 Drawing Figure

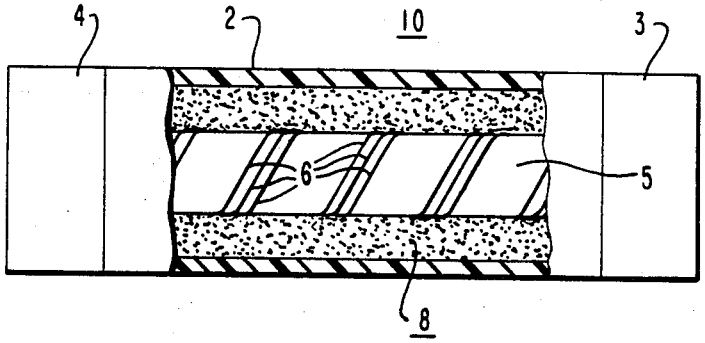
4
2
10
3
6
5
8

FUSE WITH ELECTRO-NEGATIVE GAS INTERRUPTING MEANS

BACKGROUND OF THE INVENTION

1. Field of the Invention

This invention relates generally to current limiting fuses and more particularly to current limiting fuses having fuse elements in contact with a ceramic core evolving an electro-negative gas that provides superior fault interruption characteristics.

2. Description of the Prior Art

The use of arc induced gas evolution as an aid to fault current interruption is well known in current limiting fuse design. In U.S. Pat. No. 3,437,971, entitled "Current Limiting Fuse", issued by H. W. Mikulecky on Apr. 8, 1969, a fuse element is helically wound about an organic gas evolving support. The fuse element and support are embedded in an inert granular material encased in an insulating housing. The fuse element is in contact with the gas evolving support so that when an arc is drawn, upon fusion of the element, gas is evolved directly into the arc, cooling it and improving current interruption.

Organic cores used in existing fuses have an upper limit determined by how much energy they can absorb before they are damaged to the point where electrical breakdown and hence fuse failure occurs. This deficiency serves to restrict the current and voltage ratings possible with a given design. Typical stratagems employed over the years to minimize the problem are described in U.S. Pat. Nos. 3,849,754; 3,868,619; and 3,925,745, issued to D. D. Blewitt et al. The use of localized gas evolving suppressors on a core is disclosed in U.S. Pat. No. 3,925,745.

SUMMARY OF THE INVENTION

There is provided by this invention a gas evolving mechanism which uses electro-negative gas from a solid ceramic-like core to effect and enhance arc extinction. In general, gas impingement on a current limiting fuse element arc enhances the interruption process by cooling the arc, resulting in an apparent increase in arc resistance and thus an increase in fuse arc voltage. Higher values of generated arc voltage result in more rapid and efficient arc and therefore fault current extinction. If the cooling gas is electro-negative as well, the arc voltage enhancement will be much greater. An electro-negative gas is one which has a unique ability to attract and hold electrons within its molecular structure. Hence, they have high dielectric strength and tend to extinguish power arcs.

BRIEF DESCRIPTION OF THE DRAWINGS

The single FIGURE is a sectional view of a current limiting fuse incorporating the principles of this invention.

DESCRIPTION OF THE PREFERRED EMBODIMENT

Referring to the drawing there is shown a fuse 10 which incorporates the principles of this invention. The fuse 10 is generally comprised of a tubular insulating housing 2 enclosed by electrically conducting terminal end caps 3 and 4. Centered in the insulating tubular housing and traversing the entire length thereof is a non-stoichiometric oxide core 5 used to support the fuse elements such as 6 which are helically wound around the core and attached to the electrically conductive terminals 3 and 4. The interior of the fuse housing is completely filled with granular silica sand 8.

The arcing of the fuse element causes the non-stoichiometric oxide core 5 to evolve gas. Studies involving non-stoichiometric oxides have demonstrated that when heated they evolve oxygen by decomposing the oxide. Oxygen evolution starts at as low a temperature as 400° C. and as the temperature increases, oxygen evolution increases exponentially. Thus, there is a copious evolution of oxygen as a result of intense heat generated from arcing. The important characteristic of the evolved oxygen is that it is highly electro-negative. The electro-negativity value is a measure of an atom's ability to attract electrons and oxygen has one of the highest electro-negativity values. The effect of this will be to generate a high value for the arc voltage, resulting in a more rapid and efficient arc extinction. Examples of these non-stoichiometric oxides or oxygen deficient oxides wherein the oxygen is evolved from the oxides at high temperatures are $TiO_{2-x}$, $VO_{2-x}$, $WO_{3-x}$, $MoO_{3-X}$, $CeO_{2-x}$, $NbO_{2-x}$, etc. where x is the amount of oxygen that may be evolved as a result of high ambient temperature experienced by the oxides. One of the more readily adaptable non-stoichiometric oxides that belongs to this class is zinc oxide. Experimentation has shown that the higher arc voltage generated by zinc oxide fuse models has greatly improved the interruption performance over that of previous fuse designs. The zinc oxide core essentially consists of an insulating ceramic substrate that can be easily fabricated for different fuse constructions.

Although there has been illustrated and described a specific structure, it is to be clearly understood that the same were merely for purposes of illustration and that changes and modifications may be readily made therein by those skilled in the art without departing from the spirit and the scope of this invention.

We claim:

1. A fuse, comprising:

(a) an insulating housing;

(b) electrically conductive terminal means at each end of said insulating housing for sealing the ends thereof;

(c) an elongated core traversing the entire length of the insulating housing;

(d) a fuse element helically wound around and in continuous surface-to-surface contact with the core and electrically connected to the electrically conductive terminal means; and (e) the elongated core being composed of a non-stoichiometric oxide for evolving an arc extinguishing, electro-negative gas when heated by the combination of the heated fuse element and a resulting arc during current interruption.

2. A fuse as recited in claim 1 wherein the electro-negative gas essentially consists of oxygen.

3. A fuse as recited in claim 1 wherein the insulating housing is filled with silica sand.

4. A fuse as recited in claim 1 wherein the non-stoichiometric oxide is an inorganic oxide core.

* * * * *